US006334420B1

(12) United States Patent
Yoshikawa et al.

(10) Patent No.: US 6,334,420 B1
(45) Date of Patent: Jan. 1, 2002

(54) OUTBOARD MOTOR

(75) Inventors: Yukihiro Yoshikawa; Nobuyuki Shomura, both of Hamamatsu (JP)

(73) Assignee: Suzuki Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/579,136

(22) Filed: May 30, 2000

(30) Foreign Application Priority Data

May 31, 1999 (JP) ..... 11-153044

(51) Int. Cl.[7] ..... F02F 7/00
(52) U.S. Cl. ..... 123/195 P; 123/195 E
(58) Field of Search ..... 123/195 R, 195 E, 123/195 A, 195 P; 440/900

(56) References Cited

U.S. PATENT DOCUMENTS 5,501,188 A * 3/1996 Fukuoka ..... 123/179.25
5,984,742 A * 11/1999 Kimura et al. ..... 440/77

* cited by examiner

*Primary Examiner*—Willis R. Wolfe
*Assistant Examiner*—Hai Huynh
(74) *Attorney, Agent, or Firm*—Oblon, Spivak, McClelland, Maier & Neustadt, P.C.

(57) ABSTRACT

An outboard motor comprises an engine holder, an engine disposed above the engine holder in a mounted usable state of the outboard motor, the engine being an in-line multi-cylinder type and comprising a crankcase in which a crankshaft extends vertically perpendicularly, a cylinder block disposed rear side of the crankcase, and a cylinder head disposed rear side of the cylinder block, an oil pan disposed below the engine holder, an electrical equipment, and an electrical equipment holder having an electrical equipment holding portion for holding the electrical equipments. The electrical equipment holder is mounted to the engine through a fixing portion, and the electrical equipment holding portion and the fixing portion are integrally formed of an elastic material.

12 Claims, 12 Drawing Sheets

OUTBOARD MOTOR

BACKGROUND OF THE INVENTION

The present invention relates to an outboard motor provided with an electrical equipment holder which is mounted to an outer portion of an engine of the outboard motor in consideration of countermeasure against vibration or like.

In a technical field of an outboard motor, when it is required to mount electrical equipments or parts to an outer surface of an engine of the outboard motor in a manner for preventing the electrical equipments from being vibrated, the electrical equipments are fitted in a holder formed of an elastic material such as rubber and the holder is then fixed to the outer surface of the engine through a metallic bracket or like, or the electrical equipments are directly fixed to the metallic bracket, which is then fixed to the outer surface of the engine through a cushioning member formed of an elastic material.

However, in the electrical equipment holding structures mentioned above, many elements or parts are required to fix the electrical equipments to the engine outer surface, and hence, a manufacturing cost is inevitably increased. Moreover, the metallic bracket has a heavy weight and occupies a wide mounting space, also providing a disadvantageous problem. Furthermore, in the conventional structure for mounting the electrical equipment, in order to prevent erroneous arrangement or location of the electrical equipments or wires (wirings), there are also provided problems of mounting direction of the electrical equipments and arranging the wires or like extending from the electrical equipments.

SUMMARY OF THE INVENTION

An object of the present invention is to substantially eliminate defects or drawbacks encountered in the prior art mentioned above and to provide an outboard motor having an improved electrical equipment holder of an outboard motor having a reduced parts or elements, a light weight and compact structure.

Another object of the present invention is to provide an outboard motor having an improved electrical equipment holder having an improved a vibration-proof property and capable of preventing electrical equipments or parts from being erroneously assembled or arranged and from being wetted.

These and other objects can be achieved according to the present invention by providing an outboard motor comprising:

an engine holder;

an engine disposed above the engine holder in a mounted usable state of the outboard motor, the engine being an in-line multi-cylinder type and comprising a crankcase in which a crankshaft extends vertically perpendicularly, a cylinder block disposed rear side of the crankcase, and a cylinder head disposed rear side of the cylinder block;

an oil pan disposed below the engine holder;

an electrical equipment; and an electrical equipment holder having an electrical equipment holding portion for holding the electrical equipments, wherein electrical equipment holder is mounted to the engine through a fixing portion, the electrical equipment holding portion and the fixing portion being integrally formed of an elastic material.

In preferred embodiments, the fixing portion is positioned to substantially intermediate portion of the electrical equipment, in a length direction thereof, which is held by the electrical equipment holding portion.

The electrical equipment holding portion is provided with an assembling direction defining means for defining the assembling direction of the electrical equipment and also provided with a wiring (wire) holding means for holding a wiring extending from the electrical equipment. The electrical equipment holding portion may further be provided with a wiring direction defining means for defining the wiring extending from the electrical equipment.

The holder includes a plurality of electrical equipment holding portions. The plurality of electrical equipment holding portions are formed with stages or steps so as to form a recessed portion therebetween. The fixing portion is disposed in the recessed portion between the staged electrical equipment holding portions.

The holder is detachably provided with a cover member covering a terminal portion of the electrical equipment.

According to the present invention of the structures and characters mentioned above, since a metallic bracket which has been used for the conventional structure is not needed, the number of the elements or parts can be eliminated, and hence, the manufacturing cost can be reduced and the whole weight of the outboard motor can be made small and the size thereof is made compact. According to the specific location of the fixing portion to the engine, the vibration of the electrical equipment due to the engine operation can be significantly reduced or eliminated, thus improving the vibration-proof property of the electrical equipments.

Furthermore, according to the preferred embodiments of the present invention, erroneous assembling of the electrical equipments can be assembled with less error and the wiring can be easily and surely made.

The location of the plurality of electrical equipment holding portions can further contribute the reduction of the number of the elements or parts, the reduction of the manufacturing cost, and moreover, the whole weight of the outboard motor can be made small and the size thereof is made compact. The staged arrangement of the holding portions makes easy the arrangement of the wiring of the electrical equipment, and since the electrical equipments can be effectively disposed in the recessed portions between the staged portions, the balanced arrangement thereof can be achieved and the vibration-proof property can be attained.

Still furthermore, the provision of the cover covering the terminals of the electrical equipments can improve the water-proof property and a property for preventing short-circuiting as well as improvement of an outer appearance.

The nature and further characteristic features of the present invention will be made more clear from the following descriptions made with reference to the accompanying drawings.

DESCRIPTION OF THE PREFERRED EMBODIMENTS

An embodiment of the present invention will be explained hereunder with reference to the accompanying drawings.

Figure 1:
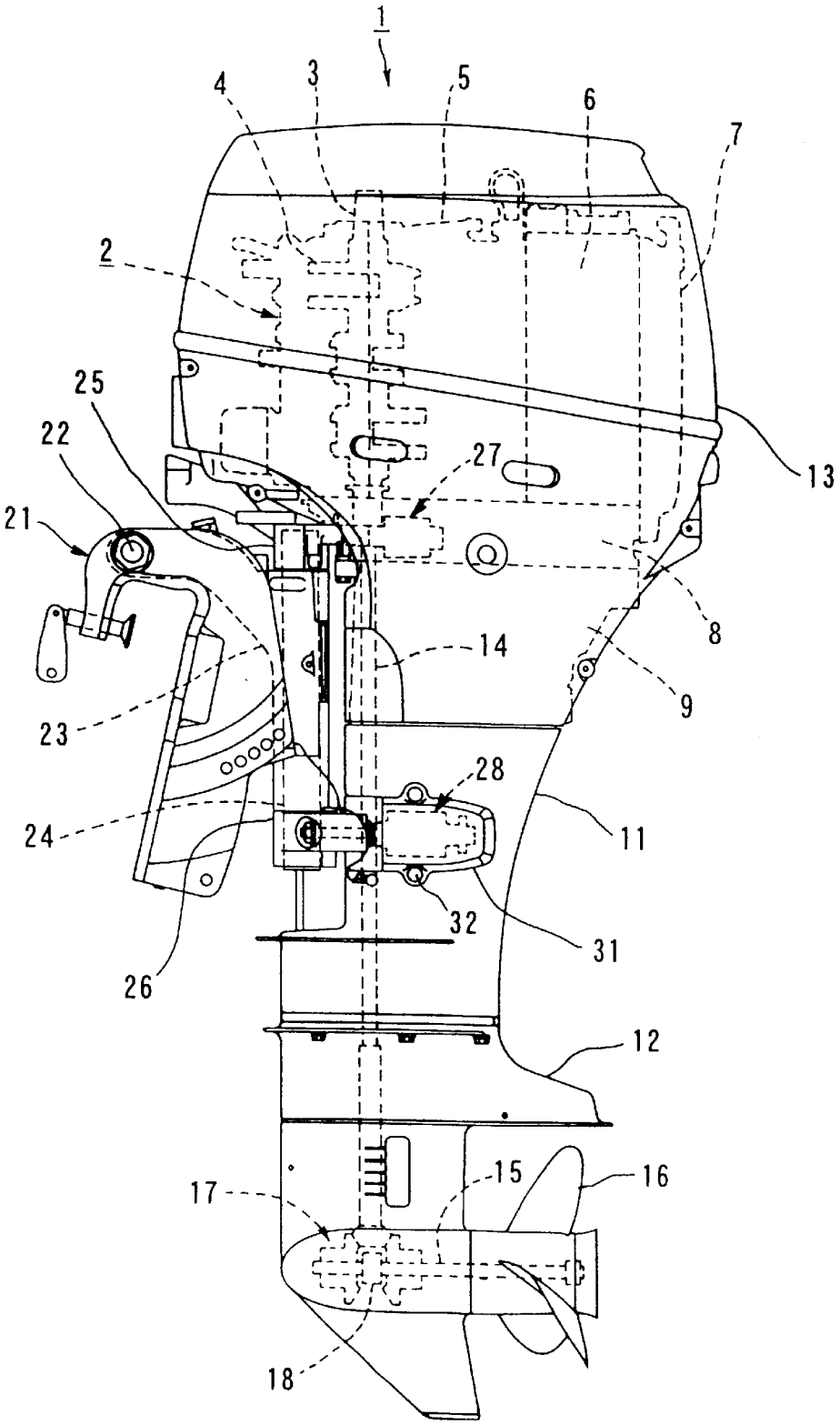
FIG. 1 is a left side view showing one example of an outboard motor of the present invention in a state to be mounted to a hull, for example.

With reference to FIG. 1, an engine 2 arranged to the upper portion of an outboard motor 1 is an in-line three-cylinder four-stroke-cycle gasoline engine, for example. A crankshaft 3 of the engine 2 rises uprightly in the vertical direction, and a crankcase 4, a cylinder block 5, a cylinder head 6 and a head cover 7 are placed on a flat plate-like engine holder 8 in this order from the front side of the outboard motor (i.e. hull side).

An oil pan 9 is fixed to a lower surface of the engine holder 8. A drive housing 11 and a gear housing 12 are fixed to a lower portion of the oil pan 9 in this order. The engine 2, the engine holder 8 and the oil pan 9 are covered with an engine cover 13 for waterproofing.

A drive shaft 14 is connected to a lower end of the crankshaft 3 of the engine 2 such that the drive shaft 14 rotates in unison with the crankshaft 3. The drive shaft 14 extends downward, vertically passes through the engine holder 8, the oil pan 9 and the drive housing 11 and then reaches inside of the gear housing 12. A propeller shaft 15 is pivotally supported within the gear housing 12 in the horizontal (longitudinal) direction and is provided, at its rear end, with a screw propeller 16 so that the screw propeller 16 rotates in unison with the propeller shaft 15.

A bevel gear mechanism 17 and a clutch shifter 18 are provided at a portion at which the drive shaft 14 and the propeller shaft 15 are intersecting. The rotation of the drive shaft 14 is transmitted to the propeller shaft 15 through the bevel gear mechanism 17 so that the screw propeller 16 is rotated to generate a propulsion force for the hull. The rotational direction of the drive shaft 14 is switched between normal direction and reverse direction, and the rotation is transmitted to the propeller shaft 15 so that the forward movement or backward movement of the outboard motor 1 (i.e. hull) is selected.

The outboard motor having the above-described structure is provided, at its front portion, with a clamp bracket 21 fixed to a hull (stern plate) of a boat or like. The clamp bracket 21 is provided with a swivel bracket 23 through a tilt shaft 22, and a steering shaft 24 vertically pivotally supported in the swivel bracket 23. The steering shaft 24 is provided, at its upper end and lower end, with an upper mount bracket 25 (steering bracket) and a lower mount bracket 26, respectively, to be rotatable together.

A pair of left and right upper mounts 27 provided in the vicinity of a front edge of the engine holder 8 are connected to the upper mount bracket 25. A pair of lower mounts 28 disposed on left and right opposite sides of the drive housing are connected to the lower mount bracket 26. With this structure, a body of the outboard motor 1 can be turned (steered) leftward and rightward around the steering shaft 24 and can be tilted up around the tilt shaft 22 with respect to the clamp bracket 21.

Figure 2:
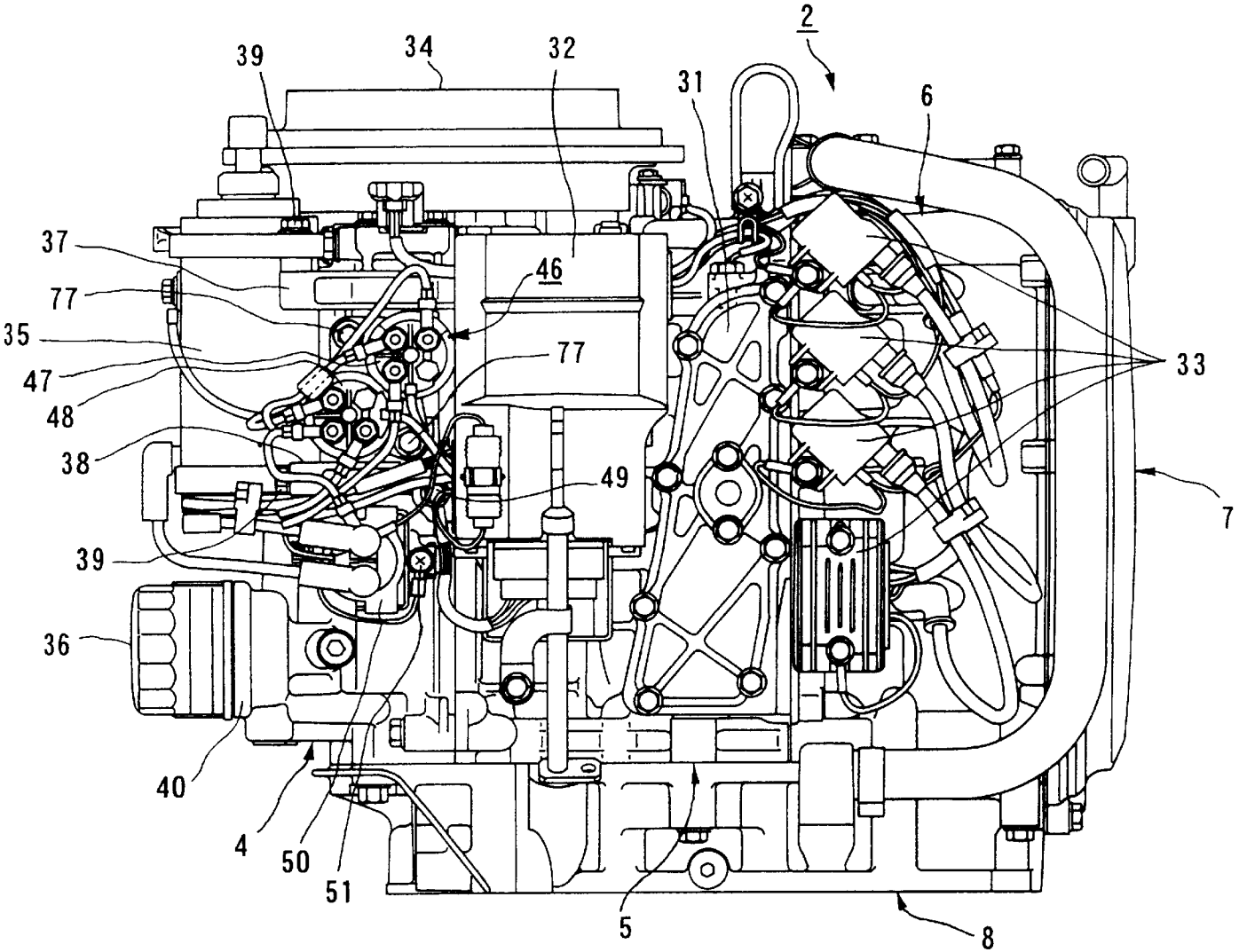
FIG. 2 is a left side view showing an engine and an engine holder of the outboard motor of FIG. 1.

FIG. 2 is a left side view of the engine 2 and the engine holder 8. Units such as an exhaust system 31, an electrical equipment box 32 and an ignition unit 33 are disposed on the left side surface of the engine 2 for example. A flywheel 34 is disposed on an upper surface of the engine 2, and a starter motor 35 and an oil filter 36 are disposed on a front surface of the engine 2.

Figure 3:
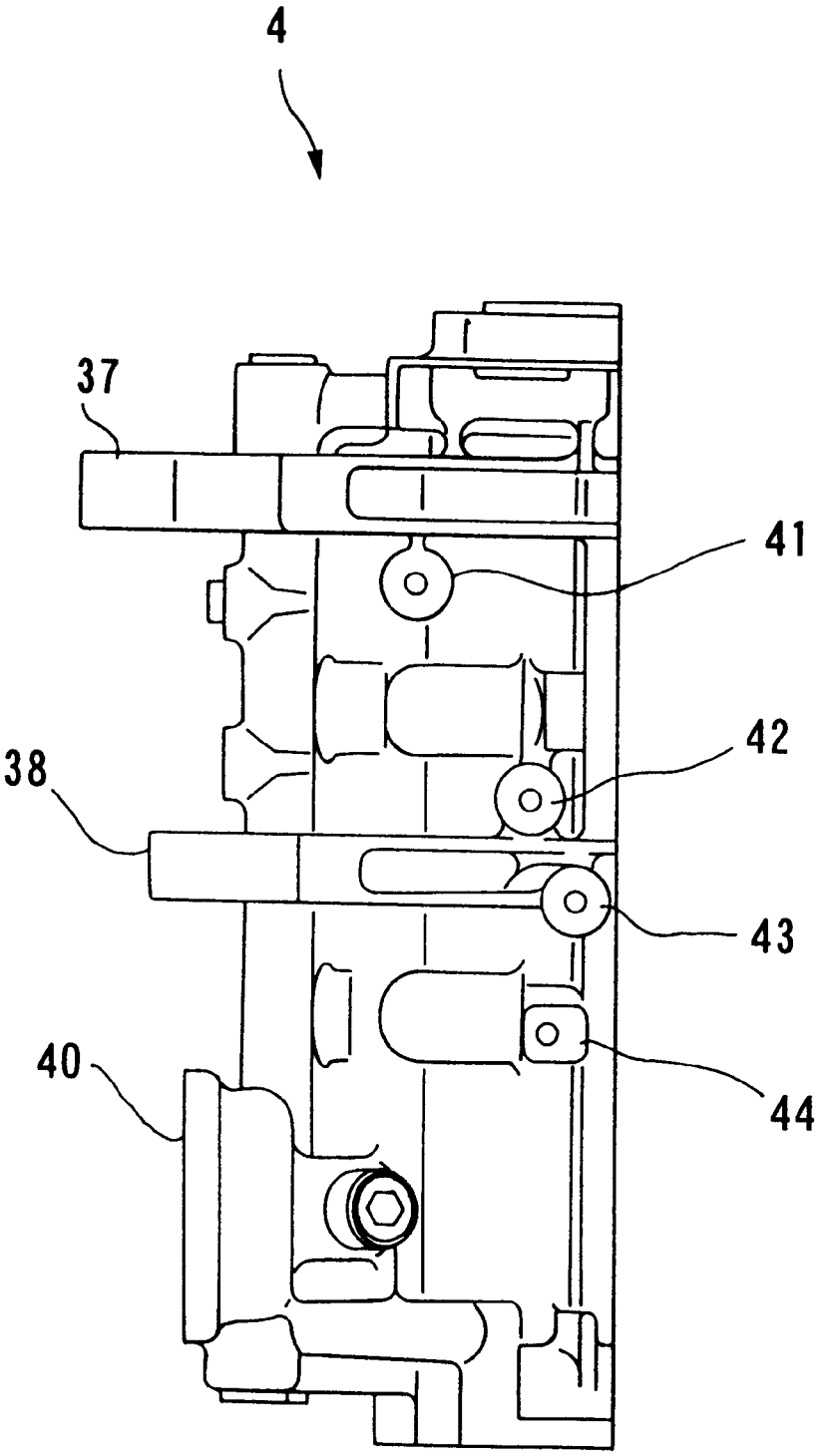
FIG. 3 is a left side view of a crankcase of the engine.

FIG. 3 is a left side view of the crankcase 4. As shown in FIG. 3, a pair of left and right starter fixing bosses 37 and 38 are provided on upper and intermediate portions of the crankcase 4, and the starter motor 35 is fixed to the bosses 37 and 38 through bolts 39. An oil filter 36 is mounted to a filter mount 40 provided on a lower portion of the crankcase 4.

Further, a plurality of part-fixing bosses 41 to 44 projecting from a left side surface of the crankcase 4 include the part-fixing bosses 41 and 42 located between the starter fixing bosses 37 and 38. The part-fixing bosses 41 and 42 are provided with two PTT (power trim and tilt) relays 47 and 48 through the electrical equipment holder 46 of the outboard motor of the present invention as shown in FIG. 2 and FIGS. 4 to 6. The electrical equipment box 32 is fastened to the part-fixing boss 43 through a bolt 49, and a starter relay 50 is fastened to the part-fixing boss 44 through a vis 51.

The PTT relays 47 and 48 are examples of electrical equipments and are relays for operating a PTT apparatus (power trim and tilt apparatus), not shown, but the relays are not limited to the PTT relays 47 and 48, and other electrical equipment may be provided in the electrical equipment holder 46. The PTT apparatus is a mechanism for turning the swivel bracket 23 in the counterclockwise direction around the tilt shaft 22 with respect to the clamp bracket 21 so as to tilt up the body of the outboard motor 1 and for finely adjusting an angle of the outboard motor 1 with respect to the hull.

As shown in FIGS. 7 to 10, the electrical equipment holder 46 is integrally formed of an elastic material such as rubber and is provided with two electrical equipment holding portions 53, 54 for respectively holding the two PTT relays 47, 48, and a pair of tongue like engine fixing portions 55, 56 fixed to the engine 2. The electrical equipment holding portions 53, 54 are formed into substantially cylindrical shapes for enveloping outer peripheral surfaces of the substantially columnar PTT relays 47, 48. Flanges 60, 61 formed around the outer peripheral surfaces of the PTT relays 47, 48 are fitted into inner peripheral grooves 58, 59 (see FIGS. 6 and 9) formed to the inner peripheral surfaces of the electrical equipment holding portions 53, 54.

Further, inner peripheral flanges 62, 63 are formed to the ends of the electrical equipment holding portions 53, 54 on the opposite sides from the engine 2 so as to surround peripheries of end faces 64, 65 of the PTT relays 47, 48. The inner peripheral flanges 62, 63 are formed with notches 66, 67, which are examples of assembling direction defining means, and the orientation of each of the PTT relays 47, 48 is determined by engaging positioning projections 68, 69 (see FIG. 5) formed on the end faces 64, 65 of the PTT relays 47, 48 with the notches 66, 67.

Figure 5:
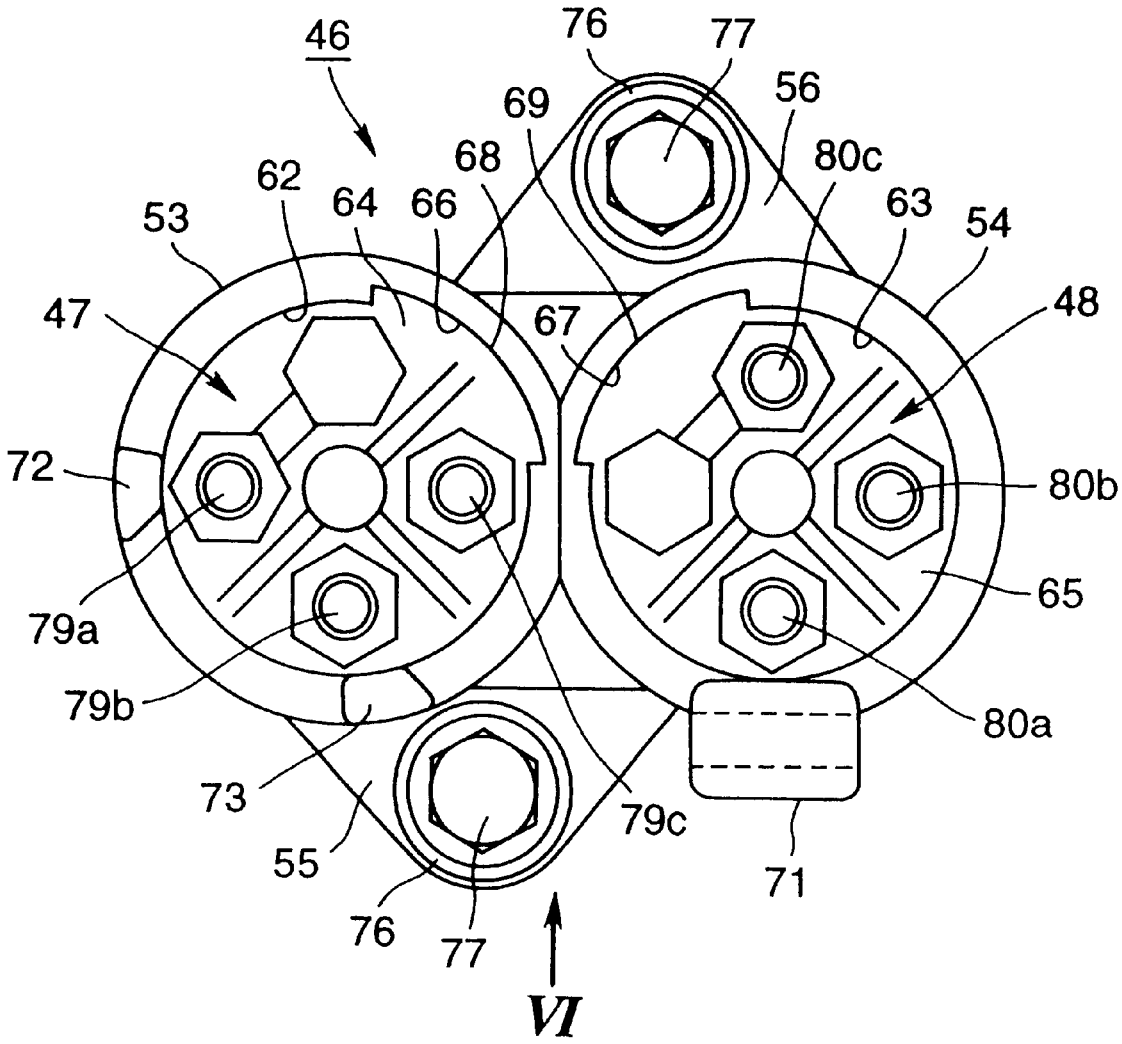
FIG. 5 is a front view of the electrical equipment holder and the PTT relay.
Figure 6:
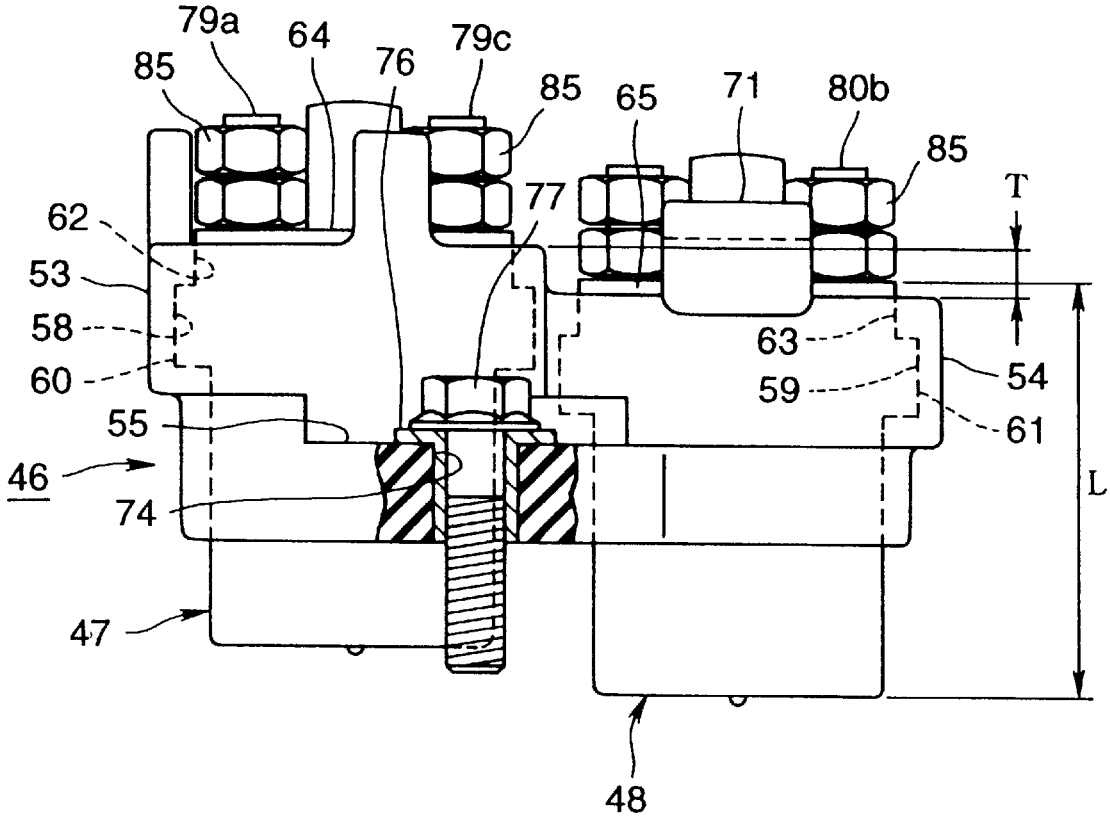
FIG. 6 is a view seen from the arrow VI in FIG. 5.
Figure 7:
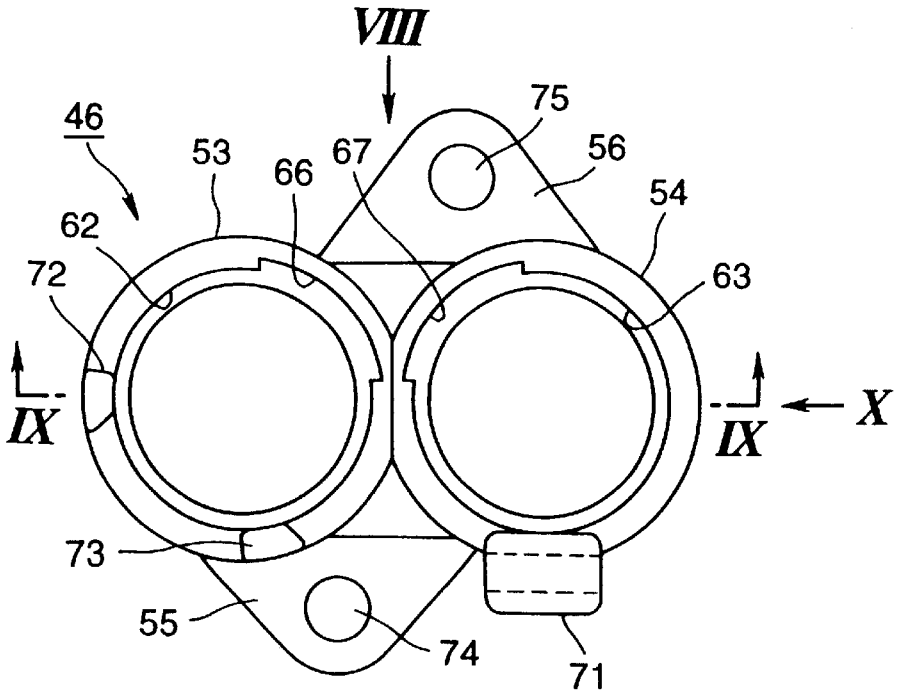
FIG. 7 is a front view of the electrical equipment holder.
Figure 8:
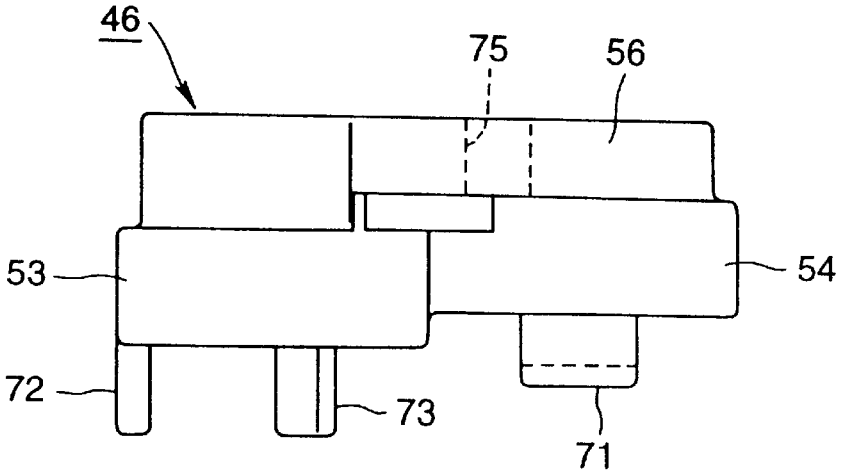
FIG. 8 is a view seen from the arrow VIII in FIG. 7.
Figure 9:
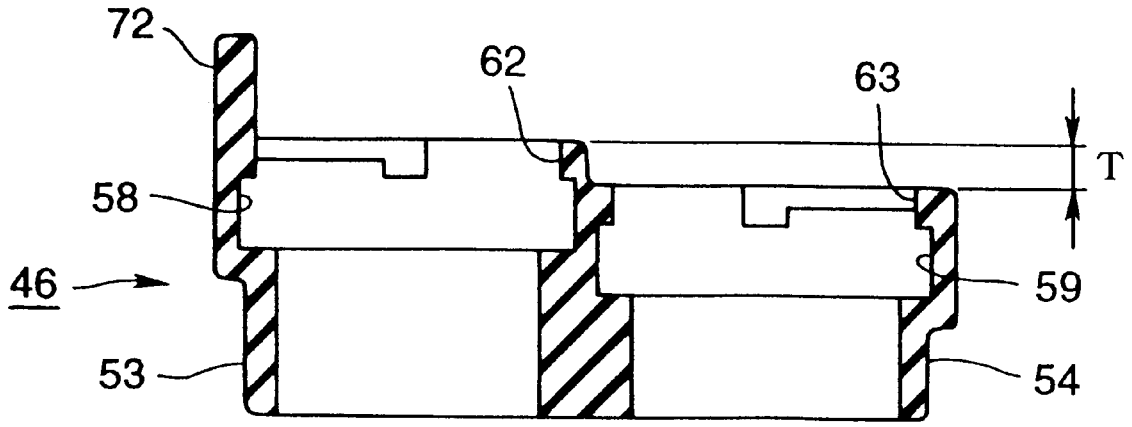
FIG. 9 is a sectional view taken along the line IX—IX in FIG. 7.
Figure 10:
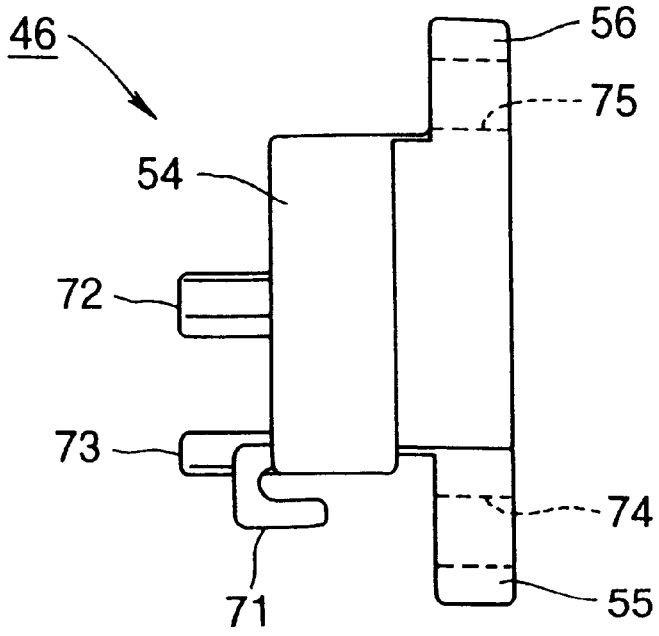
FIG. 10 is a view seen from the arrow X in FIG. 7.

As shown in FIGS. 6 and 9, the upper PTT relay 47 is located outward of the lower PTT relay 48 with respect to an outer surface of the engine 2 because a staged portion (step) T is formed between the two electrical equipment holding portions 53, 54. The lower electrical equipment holding portion 54 is formed with a wire (wiring)-holding clamp 71 and the upper electrical equipment holding portion 53 is formed with two rotation-stop (rotation-preventing) projections 72, 73. The wire-holding clamp 71 is an example of wire-holding means, and the rotation-stop projections 72, 73 are examples of wire-direction defining means. As shown in FIGS. 5 and 7, the engine fixing portions 55, 56 are positioned in recesses between the two electrical equipment holding portions 53, 54 which are arranged in an 8 (letter)-shape and are formed with bolt-insertion holes 74, 75. As shown in FIG. 6, positions of the engine fixing portions 55, 56 relative to the electrical equipment holding portions 53, 54 are set so that the engine fixing portions 55, 56 are positioned near the intermediate portions of the PTT relays 47, 48 held by the electrical equipment holding portions 53, 54 in the longitudinal direction L.

Further, as shown in FIG. 6, hat-like spacer washers 76, 76 made of steel are tightly fitted in the bolt-insertion holes 74, 75 of the engine fixing portions 55, 56, and bolts 77, 77 inserted into the spacer washers 76 are fastened to the part-fixing bosses 41 and 42 of the crankcase 4 (see FIG. 2). The fastening forces of the bolts 77, 77 are applied to the part-fixing bosses 41 and 42 through the spacer washers 76, 76. However, since the forces do not reach the engine fixing portions 55, 56 which have elastic bodies, the entire electrical equipment holder 46 can be fixed to the crankcase 4 in a vibration-proof manner.

The end faces 64 and 65 of the PTT relays 47, 48 are provided with three terminals 79*a* to 79*c* and 80*a* to 80*c*, respectively. Terminals 83*a* to 83*c* and 84*a* to 84*c* of three wires (wirings) 81*a* to 81*c* and 82*a* to 82*c* are fastened to the terminals 79*a* to 79*c* and 80*a* to 80*c* through nuts 85, respectively. The intermediate portions of the two wires 81*a*, 81*b* connected to the terminals 79*a*, 79*b* of the upper PTT relay 47 are fitted to the wire-holding clamp 71 formed to the lower electrical equipment holding portion 54 and held thereby.

Figure 4:
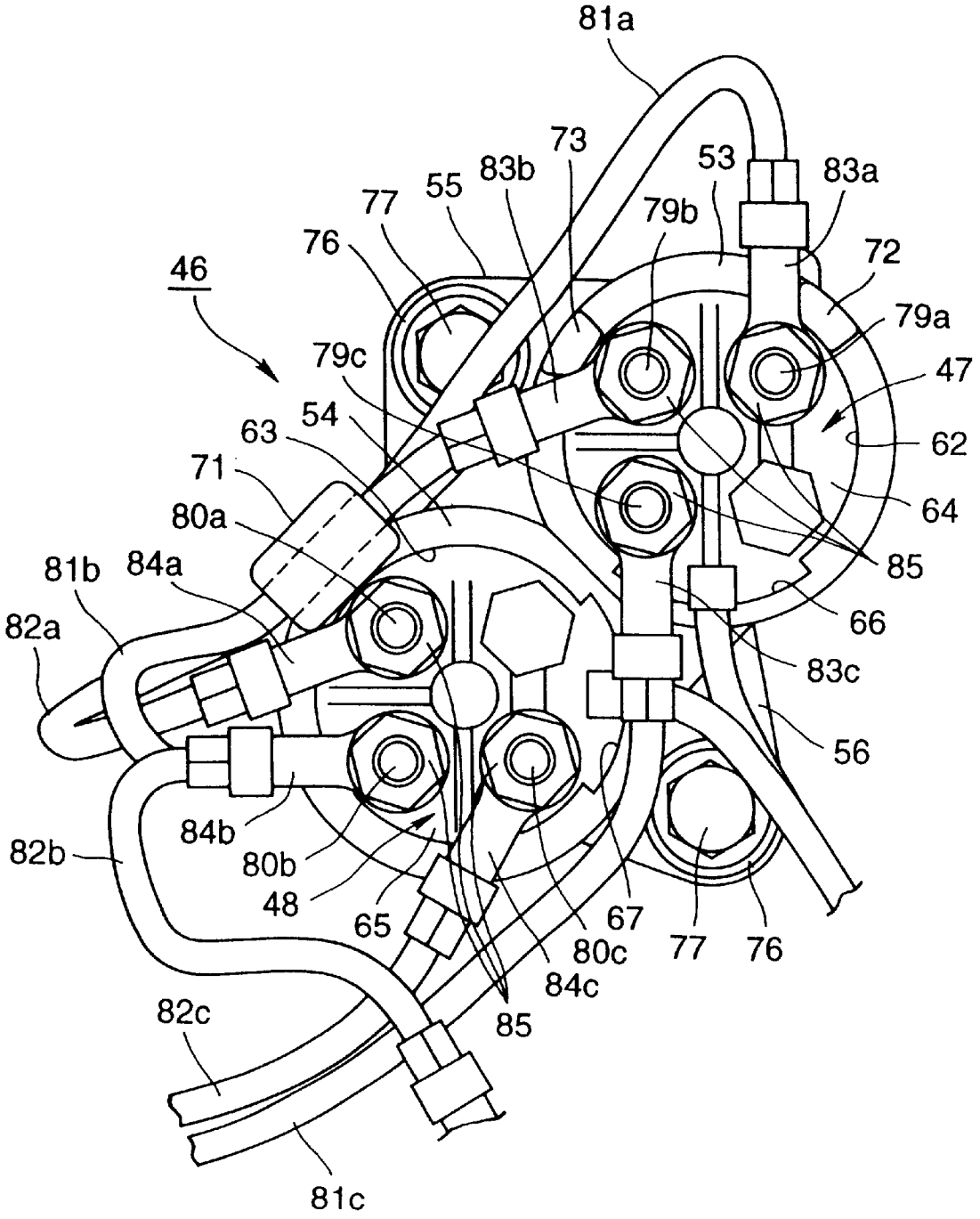
FIG. 4 is a front view of an electrical equipment holder and a PTT relay according to an embodiment of the present invention.

When the terminals 83*a* to 83*c* and 84*a* to 84*c* of the wires are fastened by the nuts 85, the terminals tend to be rotated together with the nuts in the clockwise direction. However, the terminals 83*a*, 83*b* of the wires 81*a*, 81*b* abut against the rotation-stop projections 72, 73 at a time when they are fastened by the nuts 85 and the rotation of the terminals can be prevented, and the direction of the terminals 83*a*, 83*b* are limited as shown in FIG. 4. The terminal 84*a* of the wire 82*a* connected to the lower PTT relay 48 abuts against the wire holding clamp 71 and the corotation thereof can be prevented. Therefore, the wire holding clamp 71 also functions as the wiring direction defining means.

Figure 11:
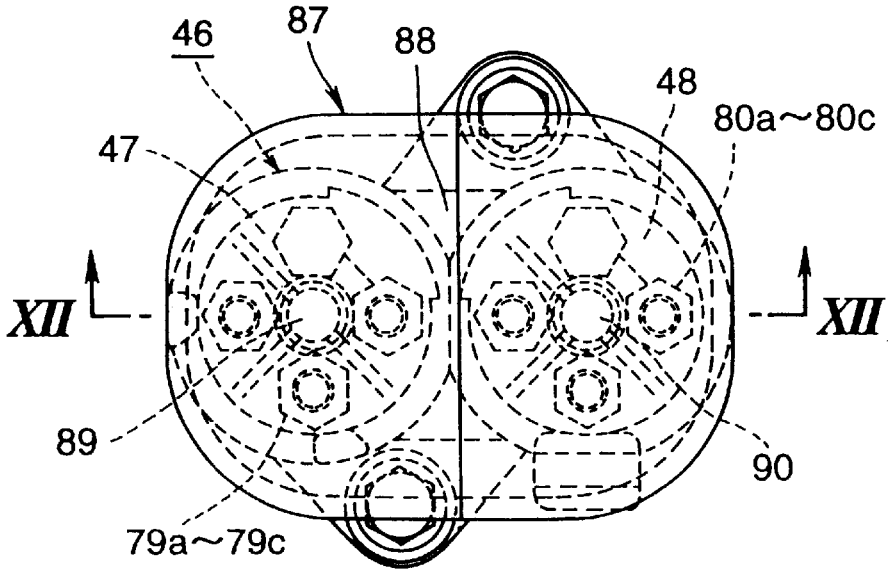
FIG. 11 is a front view showing the electrical equipment holder, the PTT relay and a cover member.
Figure 12:
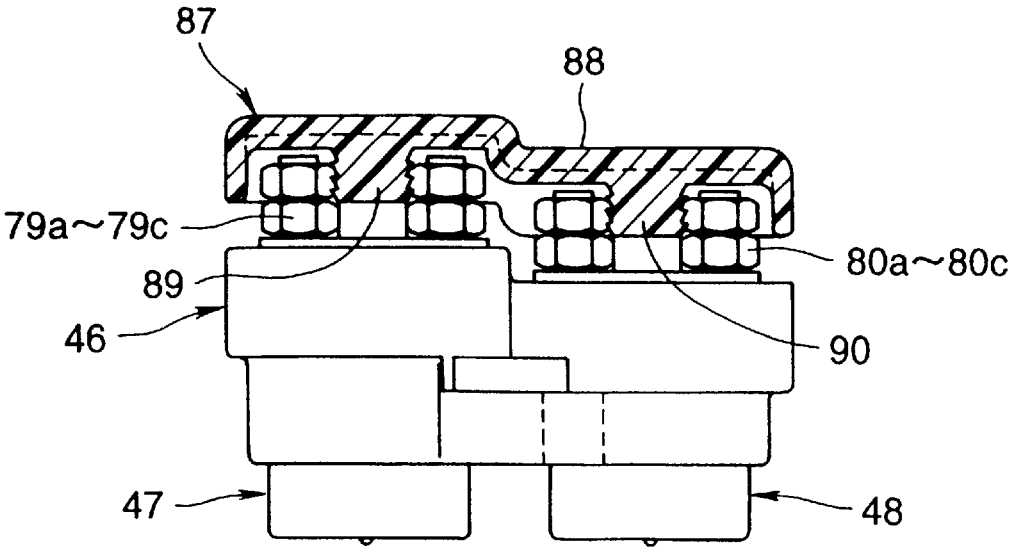
FIG. 12 is a vertical sectional view of the cover member taken along the line XII—XII in FIG. 11.
Figure 13:
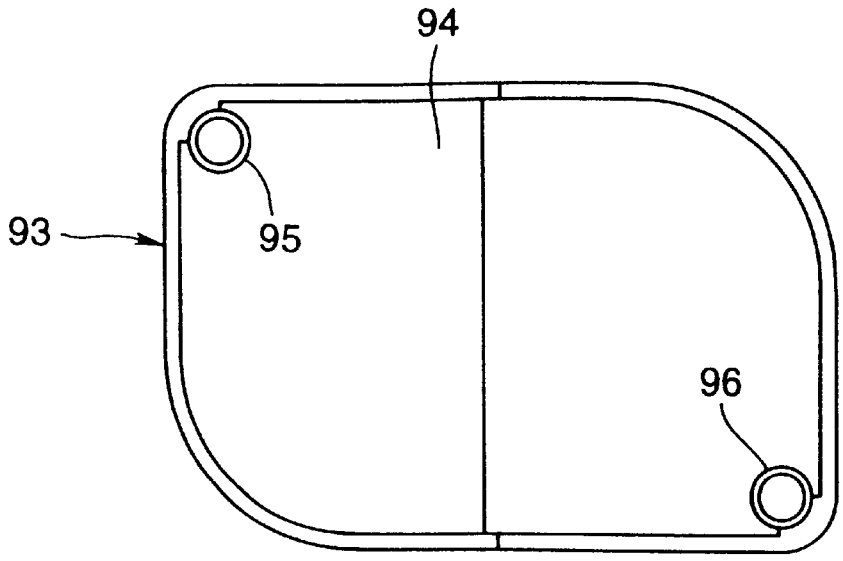
FIG. 13 is a backside view showing another example of the cover member.
Figure 14:
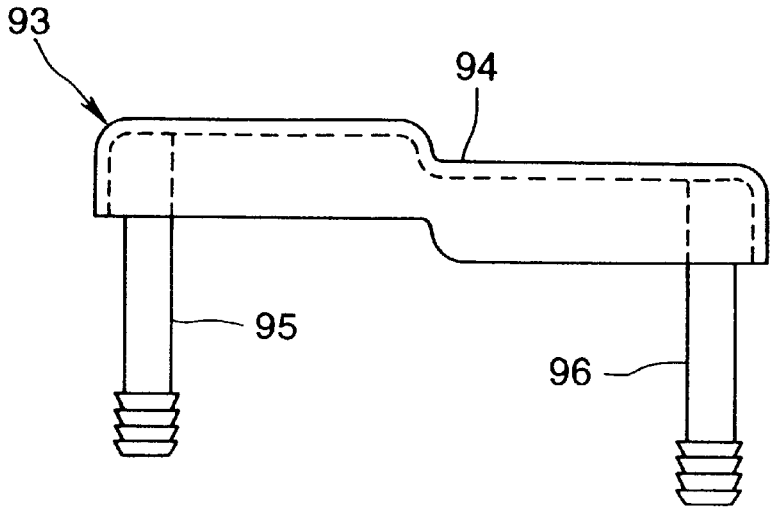
FIG. 14 is a side view showing the other example of the cover member.
Figure 15:
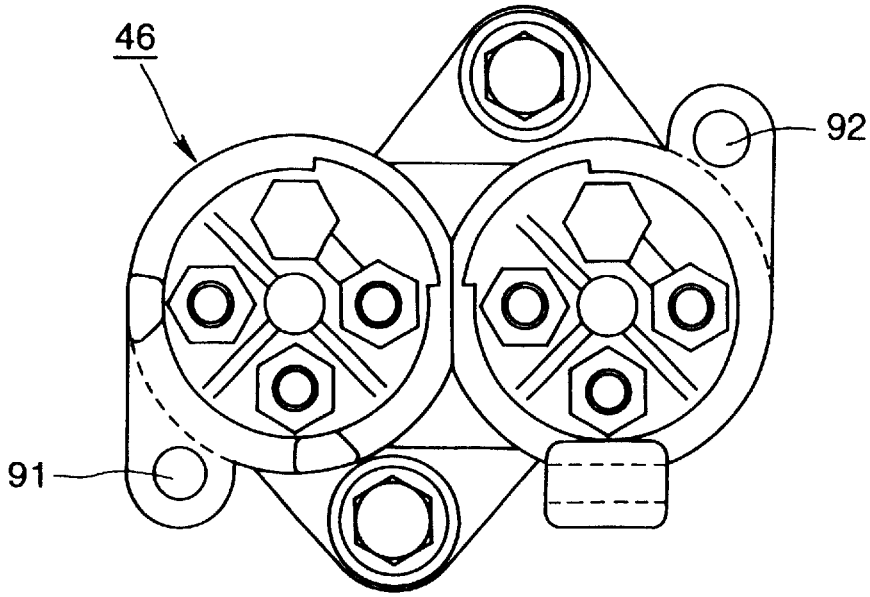
FIG. 15 is a front view of the electrical equipment holder which is formed such that the cover member shown in FIGS. 13 and 14 can be mounted.

Further, as shown in FIGS. 11 and 12, a cover member 87 is detachably mounted so as to cover the (terminal) end portions 64, 65 of the two PTT relays 47, 48 held by the electrical equipment holder 46. This cover member 87 made of a hard resin or the like has a cover body 88 for covering the terminal surfaces of the PTT relays 47, 48, and a back surface of the cover body 88 is formed with two fitting projections 89, 90. If the two fitting projections 89, 90 are press-fitted between the terminals 79*a* to 79*c*, and 80*a* to 80*c* of the PTT relays 47, 48, the mounting operation of the cover member 87 is completed. Alternatively, fitting projections 95, 96 projecting from a back surface of a cover body 94 of a cover member 93 may be press-fitted into fitting holes 91, 92 provided in both ends of the electrical equipment holder 46 on a diagonal line as shown in FIGS. 13 to 15.

In the electrical equipment holder 46 having the above-described structure, the electrical equipment holding portions 53, 54 holding the PTT relays 47, 48 and engine fixing portions 55, 56 fixed to the crankcase 4 are integrally formed with each other by using of the elastic material. Therefore, the PTT relays 47, 48 can be disposed without using metal bracket or the like, which makes it possible to reduce the number of parts to thereby reduce the manufacturing costs and to reduce the weight and the location space thereof. These effects can further be enhanced according to the present invention because two electrical equipment holding portions 53, 54 are provided on one electrical equipment holder 46, and the engine fixing portion 55, 56 are provided in the recesses between the two electrical equipment holding portion 53, 54.

Since the engine fixing portion 55, 56 are positioned near the intermediate portions of substantially the columnar PTT relays 47, 48 in the longitudinal direction L, the width of the swinging operation of the PTT relays 47, 48 caused by the engine vibration is minimized. Therefore, the vibration-proof performance of the PTT relays 47, 48 can be enhanced.

The assembling directions of the PTT relays 47, 48 are defined by engaging the positioning projections 68, 69 of the PTT relays 47, 48 with the notches 66, 67 formed to the inner peripheries 62, 63 of the electrical equipment holding portions 53, 54. Therefore, the erroneous assembling of the PTT relays 47, 48 can be prevented.

Furthermore, since the wire-holding clamp 71 is located to hold the wires 81a, 81b of the PTT relay 47 and the rotation-stop projections 72, 73 is disposed to prevent the corotation at a time when the terminals 83*a*, 83*b* are fastened to define the directions of the wires 81, 81*b*, the wires 81*a*, 81*b* are reliably held and the mounting directions thereof can be suitably defined. Accordingly, as a result, the erroneous wiring can be effectively prevented and the wiring operation can be facilitated.

Since all the notches 66, 67, the wire-holding clamp 71 and the rotation-stop projections 72, 73 are integrally formed to the electrical equipment holder 46, the number of parts can be reduced, and the shapes of the notches 66, 67, the wire-holding clamp 71 and the rotationstop projections 72, 73 are not limited to those of the embodiment mentioned above and these members may be formed into other shapes.

Because the staged-portion (step) T is provided between the two electrical equipment holding portions 53, 54, the wires 81a to 81c extending from the upper PTT relay 47 can be led above the lower PTT relay 48, thus preventing the wiring of the two PTT relays 47, 48 from colliding against each other and facilitating the wiring operation. Especially, since the high-pressure wires connected to the PTT relays 47, 48 have large diameters, it is difficult to bent these wires. Therefore, the wiring operation can be also facilitated.

In addition to the above effects, since the cover member 87 is detachably mounted to cover the terminal portions of the two PTT relays 47, 48, it is possible to remarkably enhance the water-proof performance and the short-circuiting performance and improve the outer appearance. Since the cover member 87 can easily be detached, the wires can be easily attached or detached.

Figure 16:
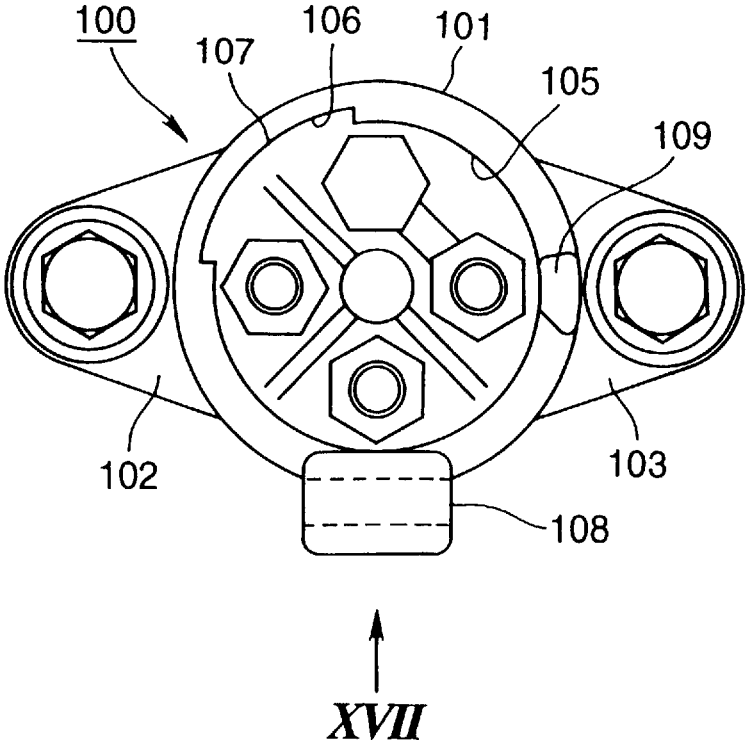
FIG. 16 is a front view showing another embodiment of the electrical equipment holder.
Figure 17:
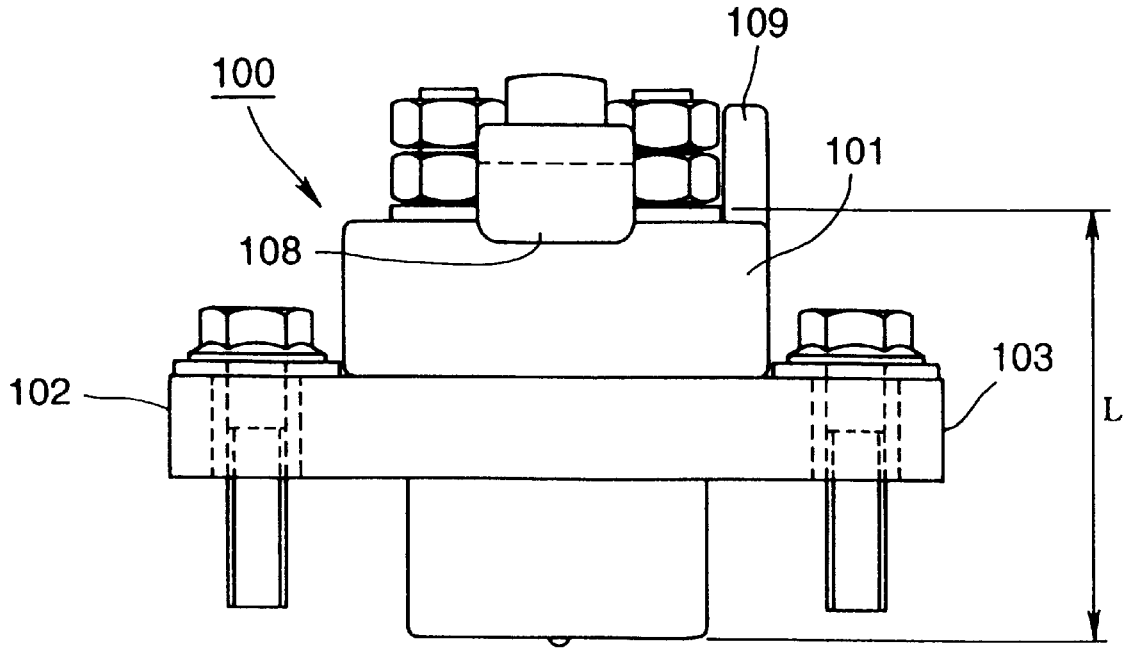
FIG. 17 is a view seen from the arrow XVII in FIG. 16.

As an electrical equipment holder 100 shown in FIGS. 16 and 17, only one electrical equipment holding portion 101 may be provided. In this electrical equipment holder 100, the electrical equipment holding portion 101 and engine fixing portions 102, 103 are integrally formed with the elastic material such as rubber, and the engine fixing portions 102, 103 are positioned near intermediate portions of a PTT relay 104 in the longitudinal direction L thereof. A positioning projection 107 of the PTT relay 104 is engaged with a notch 106 formed to an inner peripheral flange 105 of the electrical equipment holding portion 101, and the electrical equipment holding portion 101 is provided with a wire-holding clamp 108 and a rotation-stop projection 109. The operations and effects of this structure are substantially the same as those of the abovedescribed electrical equipment holder 46. A detachable cover member for covering a terminal of the PTT relay 104 may be provided separately.

As mentioned above, according to the electrical equipment holder of the outboard motor of the present invention, it is possible to reduce the number of parts to reduce the manufacturing cost and to reduce the weight and the location space as well as to enhance vibration-proof performance of the electrical equipment. Furthermore, the assembling error of the equipment and the wiring error of the wires extending from the electrical equipment can be prevented from causing, thus defining the wire direction to facilitate the wiring operation and enhancing the water-proof performance, the short-circuiting performance. The outer appearance of the electrical equipment can be improved.

It is to be noted that the present invention is not limited to the described embodiments and many other changes and modifications may be made without departing from the scopes of the appended claims.

What is claimed is:

1. An outboard motor comprising:

an engine holder;

an engine disposed above the engine holder in a mounted usable state of the outboard motor, said engine being an in-line multi-cylinder type and comprising a crankcase in which a crankshaft extends vertically perpendicularly, a cylinder block disposed rear side of the crankcase, and a cylinder head disposed rear side of the cylinder block;

an oil pan disposed below the engine holder;

an electrical equipment; and an electrical equipment holder having an electrical equipment holding portion for holding the electrical equipments, said electrical equipment holder being mounted to the engine through a fixing portion, said electrical equipment holding portion and said fixing portion being integrally formed of an elastic material.

2. An outboard motor according to claim 1, wherein said fixing portion is positioned to substantially an intermediate portion of the electrical equipment, in a length direction thereof, which is held by said electrical equipment holding portion.

3. An outboard motor according to claim 1, wherein said electrical equipment holding portion is provided with an assembling direction defining means for defining the assembling direction of the electrical equipment.

4. An outboard motor according to claim 3, wherein said assembling direction defining means comprises a notch formed to an inner peripheral flange of the electrical equipment holding portion and a positioning projection engaged with the notch.

5. An outboard motor according to claim 1, wherein said electrical equipment holding portion is provided with a wiring holding means for holding a wiring extending from the electrical equipment.

6. An outboard motor according to claim 5, wherein said wiring holding means is a wire holding clamp provided for the electrical equipment holding portion.

7. An outboard motor according to claim 1, wherein said electrical equipment holding portion is provided with a wiring direction defining means for defining the wiring extending from the electrical equipment.

8. An outboard motor according to claim 7, wherein said wiring direction defining means is a rotation-stop member formed to the electrical equipment holding portion.

9. An outboard motor according to claim 1, wherein said electrical equipment holder includes a plurality of electrical equipment holding portions.

10. An outboard motor according to claim 9, wherein said plurality of electrical equipment holding portions are formed with stages so as to form a recessed portion therebetween.

11. An outboard motor according to claim 10, wherein said fixing portion is disposed in the recessed portion between the staged electrical equipment holding portions.

12. An outboard motor according to claim 1, wherein said electrical equipment holder is detachably provided with a cover member covering a terminal portion of said electrical equipment.

* * * * *